US006161234A

United States Patent [19]

Amann

[11] Patent Number: 6,161,234

[45] Date of Patent: Dec. 19, 2000

[54] LYING SURFACE WITH LAMELLAR GRID

[75] Inventor: Guenther Amann, Frastanz, Austria

[73] Assignee: Samina Produktions - und Handels GmbH, Frastanz, Austria

[21] Appl. No.: 09/307,983

[22] Filed: May 10, 1999

[51] Int. Cl.[7] ..... A47C 23/06

[52] U.S. Cl. ..... 5/236.1; 5/238; 5/241; 5/728

[58] Field of Search ..... 5/191, 236.1, 238, 5/239, 241, 244, 701, 719, 728, 738, 727, 724

[56] References Cited

U.S. PATENT DOCUMENTS

| | | | |
|---|---|---|---|
| 2,638,606 | 5/1953 | Austin | 5/236.1 X |
| 2,838,771 | 6/1958 | Goodman et al. | 5/701 |
| 4,644,596 | 2/1987 | Husler | 5/236.1 |
| 5,553,338 | 9/1996 | Amann . | |
| 5,916,086 | 6/1999 | Rossdeutscher | 5/236.1 |
| 6,003,178 | 12/1999 | Montoni | 5/701 X |

FOREIGN PATENT DOCUMENTS

| | | | |
|---|---|---|---|
| 87 07 712 | 7/1987 | Germany . | |
| 43 02 778 | 8/1994 | Germany . | |
| WO 96/28072 | 9/1996 | Germany . | |
| WO 091001099 | 2/1991 | WIPO | 5/728 |

*Primary Examiner*—Michael F. Trettel
*Attorney, Agent, or Firm*—Darby & Darby

[57] ABSTRACT

The invention concerns a lying surface with upper cushioning body and at least two upper and lower lamellar grid, arranged parallel to each other, which are placed on elastic body in each case extending in the longitudinal direction, wherein the lower lamellar grid rests on a further lower cushioning body, which cushioning body in turn rests either on a supporting plate or merely on two spaced-apart supporting members which are fastened to the longitudinal sides of a bed frame. It may be provided that the cushioning body are covered by additional insulation fleece sheets, and certain layers of the lying surface are accommodated in fabric flap and the entire lying surface is accommodated in a covering. The entire lying surface can be rotated through 180 so that it is possible to sleep also on the lower cushioning body, wherein the two cushioning body may have a different strength. The lamellar grid may have a different spacing between their respective lamella.

9 Claims, 4 Drawing Sheets

LYING SURFACE WITH LAMELLAR GRID

BACKGROUND OF THE INVENTION

The present invention relates to a lying surface with a lamellar grid.

Such lying surfaces with a lamellar grid have become known through the inventor's own applications. Subject of these applications is a resilient body which consists of beam-like elastic bodies extending in the longitudinal direction which have an upper and a lower supporting surface for an upper and a lower lamellar grid. Each lamellar grid consists of relatively thin and fine lamellae which are joined together relatively tightly in order to achieve a very elastic lying surface with good point by point adapting to the body lying thereon. It is known to place this resilient body with the upper and lower laminar grid directly on two parallel support members which are fixed to lateral faces of a bed frame. This construction has proved itself well because especially the lower lamellar grid is able to swing freely between the spaced-apart support members, thereby providing a good counter pressure and a good equalisation.

However, such a construction is not suited for certain bed constructions.

When a resilient body is placed on a continuous supporting surface, it is no longer possible for the lower lamellar grid to develop swings and the lamellar grid will then lie flat on the supporting surface, unable to swing. The result is that the entire effect of the resilient body is greatly reduced and a lying surface formed by a resilient body is therefore no longer suited to provide a suitable support for the body of the sleeping person.

OBJECT OF THE INVENTION

The objects of the invention therefore is to develop a lying surface, with upper and lower laminar grids, arranged parallel to each other, which are placed on elastic bodies in each case extending in the longitudinal direction, in such a way that such a lying surface can be advantageously used on essentially continuous, totally flat supporting surfaces.

SUMMARY OF THE INVENTION

Thus, according to the invention, there is provided a lower laminar grid rests on a further lower cushioning body, which cushioning body in turn rests on the supporting plate and covers the support plate at least partly.

In one embodiment of the invention, the swinging and flexing, especially of the lower part of the lamellar grid, is achieved in such a way that lamellar grid rests on a lower cushioning body and this cushioning body itself rests on the supporting surface for the entire lying surface and partly or completely covers this lying surface.

The present invention provides for continuous supporting surfaces, such as are used especially in Anglo-Saxon countries and sold under the name Red-BOX. With the construction according to the invention it is now possible for the first time to achieve an excellent way of adapting a body to a lying surface. This is achieved by arranging above the uppermost lamellar grid a first, upper cushioning body, which absorbs the body weight of the sleeping person relatively evenly and transmits this to the upper lamellar grid.

This upper lamellar grid at certain highly stressed points will flex but at other points where there is no great bearing stress, a counter pressure is developed, i.e. in other regions the lamella push upwards against the body. This results in excellent adapting to the body contour, because the lamellae of the upper lamellar grid flex downwards as well as counteract the body lying upon it, and produce a counter pressure.

The body therefore has points where it needs support from below and it has points where a lowering is required. The lowering in this case is situated in the buttock region, where tests have shown that the lamellae in this region flex downwards, the same in the shoulder region, whilst in the lumbar region the lamellae of the upper lamellar grid arch upwards in convex manner and go towards the body and form out in convex manner the upper cushioning body pointing upwards, so that the body is supported here in an advantageous manner.

The mechanical effect on the upper lamellar grid is complemented and improved by the mechanical effect of the lower lamellar grid. If there was only one upper lamellar grid, then all the lamellae of the upper lamellar grid would sink only downwards, which would not provide an effective body support.

This is were the lower lamellar grid comes in, which, via the elastic body situated between the upper and lower lamellar grid, is stressed by the upper bearing force of the body and also flexes its lamellae at the corresponding points either convexly upwards or concavely downwards. It has been discovered that the upper and lower lamellar grids essentially always move synchronously, i.e. at those points where the upper lamellar grid arches concavely downwards the lower lamellar grid will also arch concavely downwards. In order to effect this arching there is provided the lower cushioning body, the lower lamellar grid flexing into its material or the lower lamellar grid partly flexing into its perforations where it is subjected to a corresponding counter force.

In this case it is preferred if also the distance of the lamellae of the upper lamellar grid and the lower lamellar grid is different when viewed over the length of the lying surface.

When the lying surface is divided into three regions of 25%-50%-25% according to length, it is preferred if the lamellae in the region with 25% have a greater mutual distance from each other than the lamellae in the middle 50% region. Here too the counter force on the body is substantially improved and increased.

It was stated above that a substantial efficiency mechanism by the swinging of the upper and lower lamellar grids consists in that the lower lamellar grid swings into the lower cushioning body itself or partly into the openings of the lower cushioning body and here is subjected to a corresponding counter force.

Of course the invention is not restricted to the arrangement of two lamellar grids arranged parallel to each other. Reference is made to the inventors own U.S. Pat. No. 5,553,338 which discloses the same arrangement with three spaced-apart lamellar grids and this embodiment is incorporated herein by reference. However, in the instant application, only the cooperation of three lamellar grids, which form one resilient body. This document does not teach how such a resilient body can be placed on an essentially continuous supporting surface and then still retain the optimum spring characteristics of this resilient body.

However, the invention is not limited only to the placing of the entire lying surface on a continuous supporting surface, but in a further development of the invention it is provided for that the entire lying surface with its lower cushioning body is placed on only two spaced-apart supporting members which are secured to the longitudinal sides of a bed frame. In this case too it is ensured that the lower cushioning body together with the lower lamellar grid lying on this can swing freely between the supporting members.

Another advantage of the present invention is that, apart from the lower cushioning body, there is also a symmetrical upper cushioning body which rests on the upper lamellar grid. Relative to a longitudinal center plane there is provided a completely mirror symmetrical arrangement of the lying surface which makes it possible for the entire lying surface to be rotated 180°, so that the upper cushioning body comes to lie on the bottom and the lower cushioning body on top forms the supporting surface for the human body.

It may be provided in this case that the mechanical density of the upper and lower cushioning body differs from each other, so that for example the upper cushioning body is harder than the lower cushioning body, in order thereby to create a lying surface of different hardness when the mattress is turned.

In another embodiment of the invention the provision may be made that both the upper cushioning body as well as the lower cushioning body are also covered by additional insulation fleece sheets which seal the cushioning body in each case at the top and bottom. Such an insulation sheet consists for example of sheeps wool, coconut fibres or the like and has the purpose of achieving a better moisture absorption and an improved heat insulation.

The arrangement of a central lamellar construction consisting of two spaced-apart lamellar grids which between them form an air space also achieves an advantageous pump action. This substantially improves the ventilation of the entire lying surface. Since a central air space is now available, which is limited towards the top by an upper lamellar grid and towards the bottom by a lower lamellar grid, each body movement of the sleeping person causes a compaction of the upper and the lower cushioning body into the said air space, and this causes the air volume trapped here to be compressed or expanded so that this air volume can escape through the upper cushioning body as well as also through the lower cushioning body. Thereby, an excellent ventilation of the lying surface is achieved. In the cushioning body and optionally also in the insulation fleece sheets the air used up and enriched with humidity is transported to the outside in an advantageous manner by the said pump action.

The good adaptability of the lying surface to the body contour, as a result of using lamellar grids with fine link members, ensures that such a lying surface is preferably also used in sub-structures which are electro-mechanically adjustable. For example, very gently the head part or the foot part may be raised by an electric motor and the entire lying surface adapts to this adjusting movement in a very sensitive manner.

The entire construction therefore consists of upper and lower insulation fleece sheets which in each case rest on upper and lower supporting surfaces of the upper and lower cushioning bodies. Between the upper and lower cushioning bodies is arranged the said resilient body. This consists of the aforementioned upper and lower lamellar grids which rest on central elastic bodies extending in the longitudinal direction. The number of elastic bodies distributed over the width of the lying surface is thus immaterial. In the case of narrow lying surfaces only two elastic bodies are used, which are arranged laterally in each case. The wide lying surface may consist of three or four elastic bodies extending parallel and spaced-apart to each other over the entire length of the lying surface and form the supporting surface for the upper lamellar grid and the contact surface for the lower lamellar grid.

Likewise, the height and composition of the elastic body play only a limited roll. It is preferred in this case that the elastic bodies are made from a natural latex material.

The entire structure is preferably contained in an enveloping covering which is opened and closed for example by a zip fastener.

However, since this relates to a relatively thick structure consisting of an upper insulation sheet, an upper cushioning body, the central resilient body, the lower resilient body and the lower insulation fleece sheet, in a further development of the invention it is provided that three layers of this structure are connected to each other by fabric flaps.

As the upper layer in his case is described the upper cushioning body with the insulation fleece sheet lying on top of this, whilst the as he centre layer is described the aforementioned resilient body and as the lower layer is described the lower cushioning body with the lower insulation sheet.

Provided for now is that the lower layer is fastened by means of a fabric flap which, in the form of a tunnel-shaped fabric flap continues in the direction of the centre resilient body, and this fabric flap itself is closed over the width of the lying surface. Into this in itself closed fabric flap is then inserted the centre resilient body.

The same applies to the holding of the upper layer against the centre resilient body. Here too the upper layer is firmly tied with a fabric flap and this fabric flap extends with its hollow space over the centre resilient body and this centre resilient body is inserted in the fabric flap. In this way is releasably connected via fabric flaps both the upper layer with the centre resilient body as well as the lower layer with the centre resilient body.

These said fabric flaps cause the lateral stability of the entire lying surface to be substantially improved, i.e. it cannot yield so much laterally.

Provision can also be made to have a fabric flap encompassing all three layers together.

Such fabric flaps can be distributed at regular intervals over the entire length of the lying surface.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
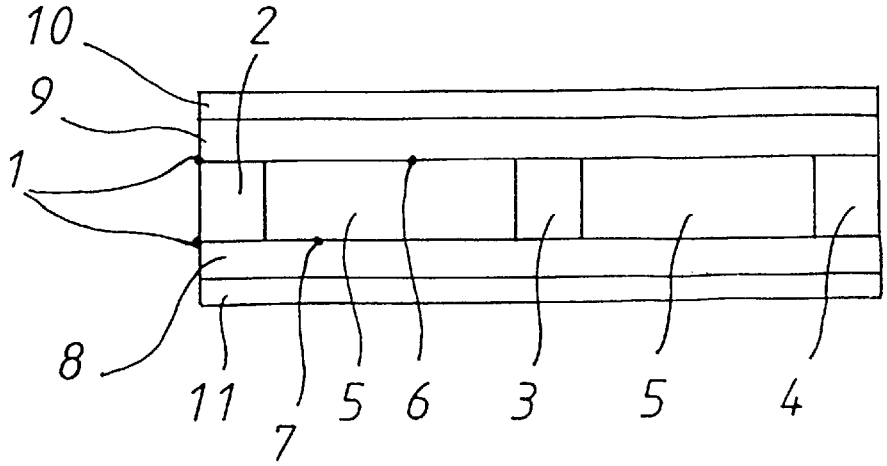
FIG. 1 is a diagrammatic view of an end face of the lying surface according to the invention.
Figure 2:
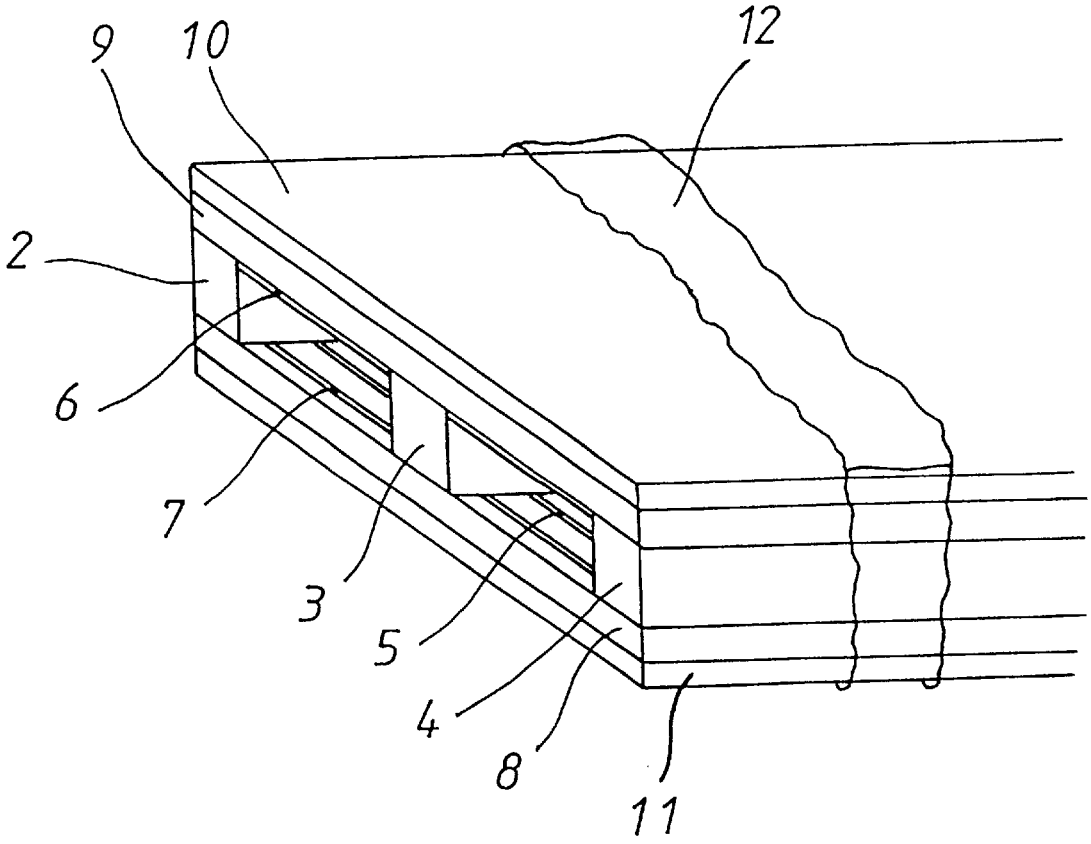
FIG. 2 is a perspective side view of the arrangement according to FIG. 1.

In FIGS. 1 and 2 show a central resilient body 1 which essentially consists of an upper lamellar grid 1 and a lamellar grid 7 running parallel to this and arranged spaced-apart from each other. Both lamellar grids consist of relatively thin lamellae which are placed laterally on elastic bodies 2, 3, 4 arranged parallel to each other. For holding the lamellae of the individual lamellar grids 6, 7 (not shown), flaps are sewn onto the elastic body in which are inserted the end faces of the respective lamellar grids 6, 7.

Between the upper and lower lamellar grids 6, 7, hollow spaces 5 filled with air are thus formed between the elastic bodies 2, 3, 4 in the longitudinal direction and passing through the lying surface.

The entire central resilient body rests on a lower cushioning body 8 and is covered by an upper cushioning body 9.

The FIGS. 1 and 2 additionally show that the upper cushioning body 9 can be covered by an upper insulation fleece sheet 10 whilst the lower cushioning body 8 can rest on a lower insulation fleece sheet 11.

The FIG. 2 shows also diagrammatically that the entire lying surface can be encased by a covering 12, which completely seals off the lying surface. Such a covering 12 may be provided with a zip fastener or another opening means.

Figure 3:
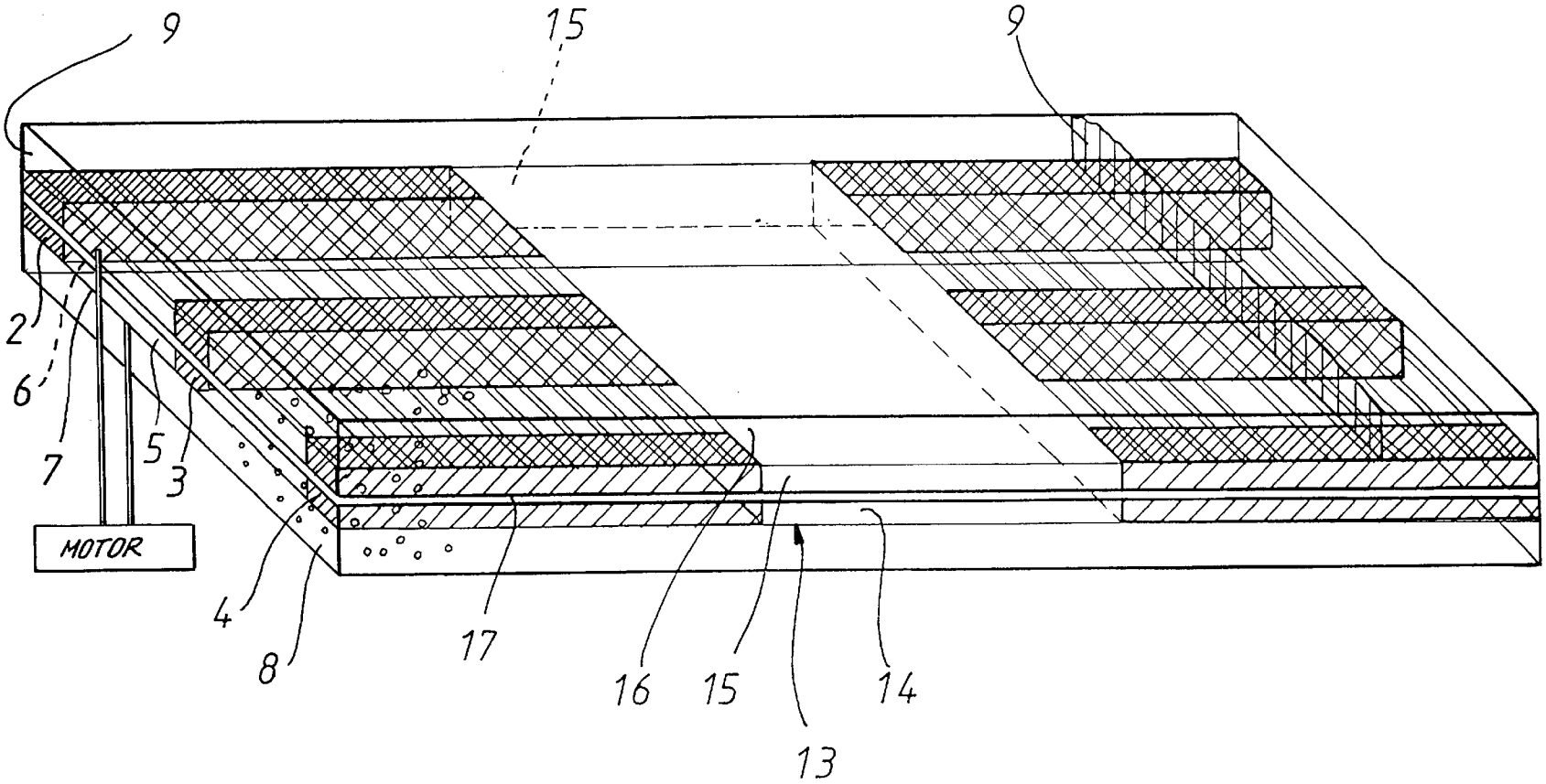
FIG. 3 is a schematic plan view of the arrangement according to FIG. 2 with a partial sectional representation of a fabric flap.

From FIG. 3 can be seen further details, in which a lower fabric flap 13 serves to connect the central resilient body 1 with the lower layer comprising of a lower cushioning body 8 and the insulation fleece sheet 11.

For this is provided that the lower surface 14 of the fabric flap 13 is fastened to the surface of the lower cushioning body 8. Such a fastening is effected for example by sewing or gluing. This lower surface 14 extends into an end face 15 at right angles to this which extends along the end face of the resilient body 1 and then again extends at right angles into the upper surface 16, which encloses the resilient body 1 from the top. This end face 15 is present in the same way on the other side, thus forming a closed fabric flap 13 in the hollow space of which is inserted the central resilient body 1.

In analogous manner is effected the fastening of the upper layer consisting of the upper cushioning body 9 and the upper insulation fleece sheet 10. To the underside of the upper cushioning body would be secured the aforementioned surface of a fabric flap and this fabric flap in turn forms a hollow space through which is passed the central resilient body 1.

In this way therefore are connected by means of the fabric flap both the upper as well as the lower layer to the central resilient body 1.

Figure 4:
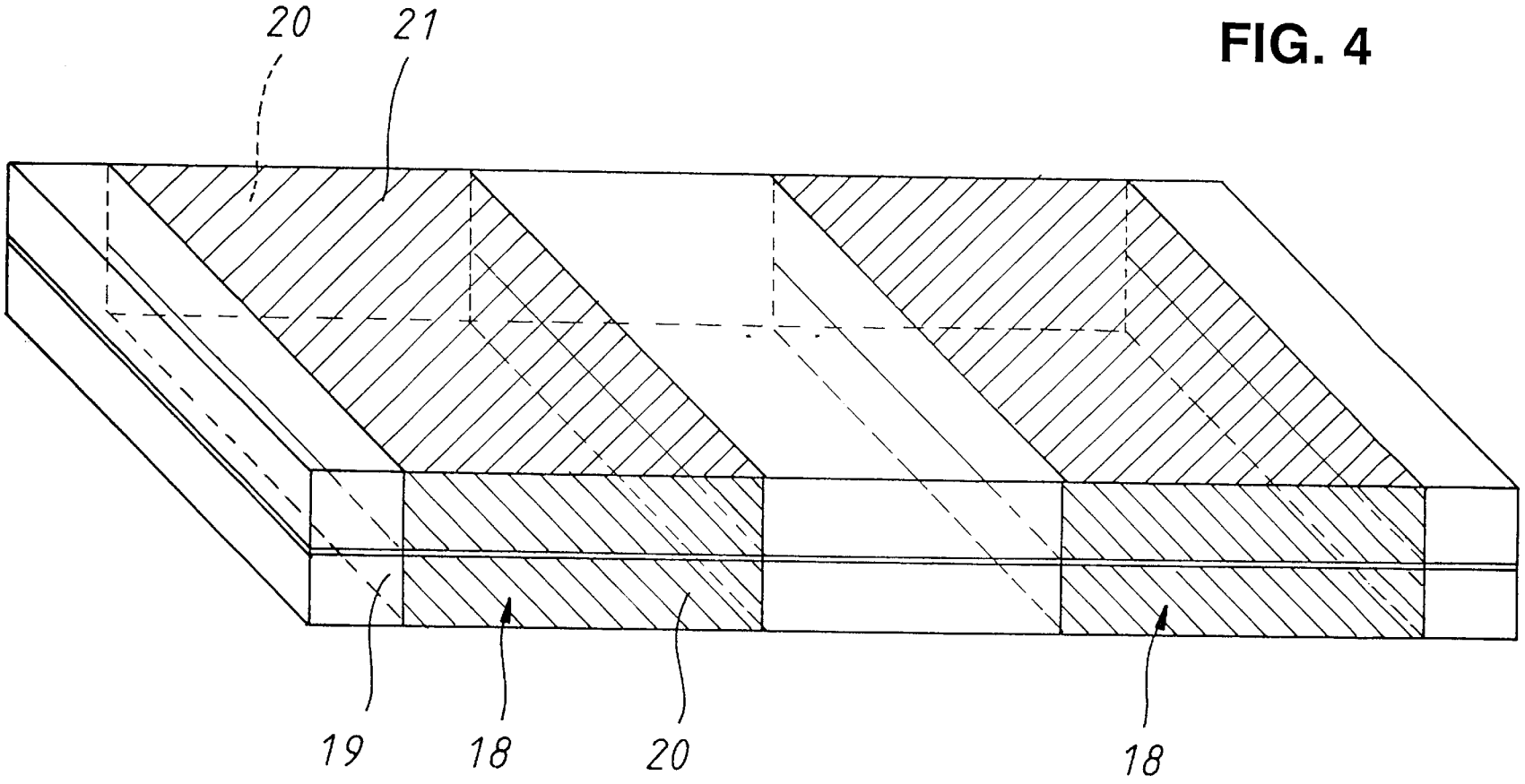
FIG. 4 is a development of fabric flaps at variance from that shown in FIG. 3.

FIGS. 3 and 4 also show an outer covering which can be opened by a zip fastener 17.

Compared to FIG. 3, the FIG. 4 shows a variant of this which shows the two spaced-apart fabric flaps 18.

In this case the two fabric flaps are so constructed that one lower surface 19 of the fabric flap 18 is fastened to the underside of the lower resilient body 8 and the end face 20 extends up to the top surface of the upper resilient body 9 and there forms a continuous upper surface 21 which in turn is connected via an end face 20 to the lower surface 19. This therefore shows a closed fabric flap 18 through which are passed all three layers of the arrangement.

The lying surface includes two outer regions 30' and 30", and the lamellae (23, 24) in the two outer regions 30' and 30" are further spaced apart from on another than the lamellae disposed in the center region 30 of the lying surface. The outer regions extend over about 25% of the length of the lying surface, when viewed in the longitudinal direction. The center region 30 extends between the outer regions.

Figure 5:
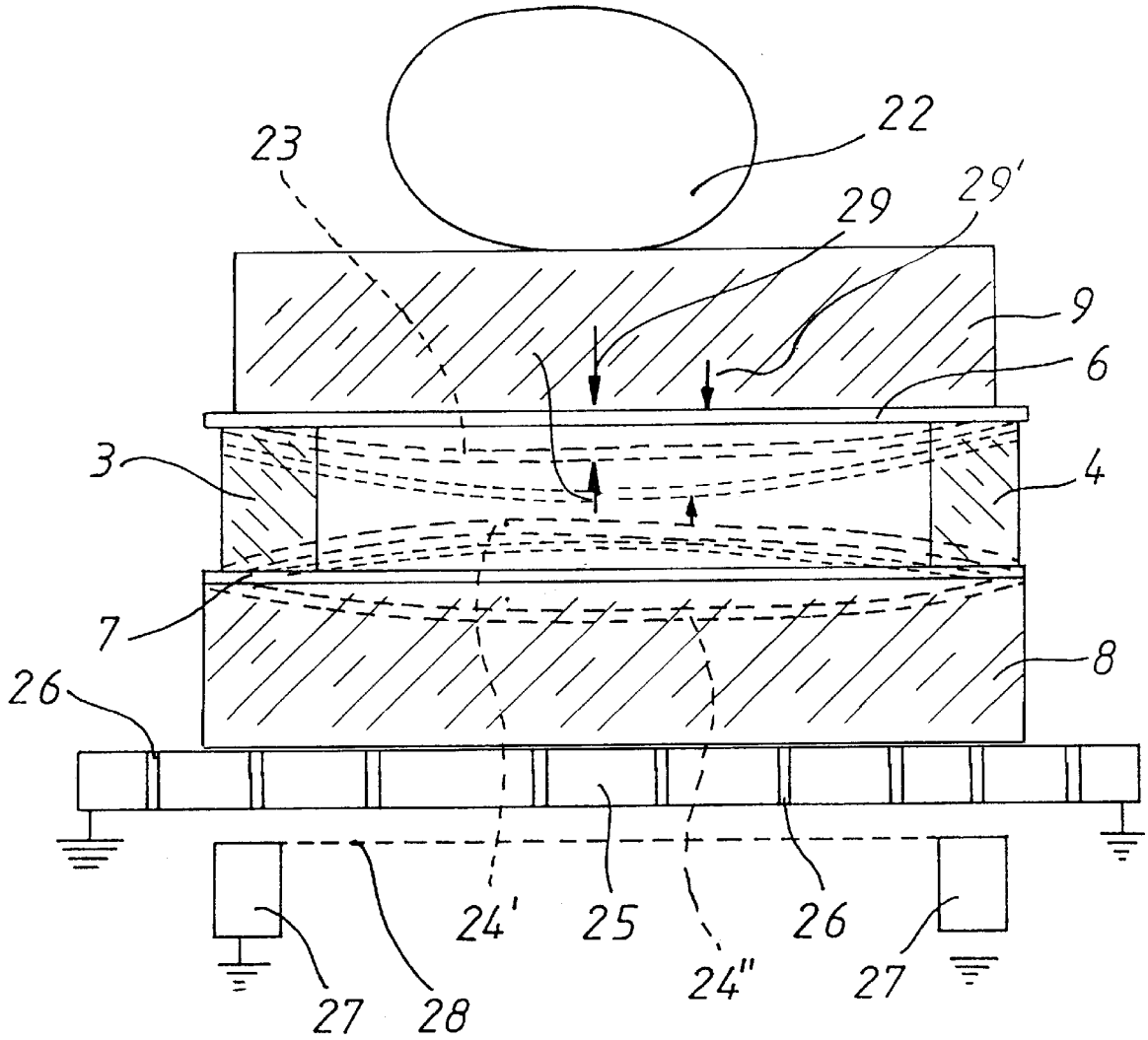
FIG. 5 illustrates diagrammically a section through the lying surface according to FIG. 1 and FIG. 2 showing the spring performance.

FIG. 5 shows the bio-mechanical effect of the lying surface according to the invention.

The body 22 lying on the upper cushion 9 exerts a bearing pressure on the upper lamellar grid 6 in the direction of the arrow and 29'. In the bearing region this causes individual lamellae 23 to flex downwards (see general description).

Other lamellae (not shown diagrammically) of the upper lamellar grid do however extend into the upper cushioning body 9, i.e. they bend convexly upwards and create a corresponding counter pressure.

The same now applies for the lower lamellar grid 7 and the two lamellae 24, 24 shown there. After the lower lamellar grid 7 moves synchronously with the upper lamellar grid 6, a proportion of the lower lamellae flex upwards in the direction of the arrow 29 (i.e. into the hollow space 5), as shown with the lamella 24, other lamellae, for example the lamella 24, flex into the lower cushioning body 8 and rest here in resilient manner, where they are subjected to a corresponding counter pressure.

Important therefore is that the lower lamellar grid 7 can swing freely into the lower cushioning body 8 and the cushioning body 8 itself forms the support for the lying surface on a continuous, relatively firm and flex-resistant supporting plate 25. For the improved ventilation, drillings 26 are distributed over the surface of this supporting plate 25.

The FIG. 5 shows as an alternative that the supporting plate 25 can be dispensed with and that instead there are provided two or more lateral supporting members 27 on which the edge portions of the lower cushioning body 8 are placed. These two supporting members 27 thus form a bearing plane 28 for the lower cushioning body 8, thereby dispensing with the supporting plate 25.

The present lying surface according to the invention is therefore substantially superior to the known spring core mattresses which rest on supporting plates which are resistant to bending. It adapts better to the body contour, has better drainage for the body moisture, better insulation effect and in particular is free of metal, i.e. it contains no metal parts or otherwise damaging parts. It has indeed been shown that the metal parts contained in spring core mattresses lead to a distortion of the earths magnetic field, which acts on the human body, and this distortion is prevented by the completely metal-free lying surface according to the invention. The increasing electro-smog in our environment causes the eddy currents in the metal parts of the conventional spring core mattresses to be coupled to the corresponding fields in the body, which can be associated with damage to health. This is surely prevented with the lying surface according to the invention.

What is claimed is:

1. A lying surface comprising an upper cushioning body (9) and at least two upper and lower lamellar grids (6, 7), arranged parallel to each other, and which are placed over and under at least two elastic bodies (3, 4) which each extend in a longitudinal direction, wherein the lower lamellar grid (7) rests on a lower cushioning body (8), the cushioning body (8) rests on a supporting plate (25) and at least partly covers the supporting plate (25).

2. The lying surface according to claim 1, wherein the upper and lower lamellar grids (6,7) comprise lamellae (23,

24), the lamellae (23, 24) of the upper and lower lamellar grids (6,7) being spaced apart differently over the length of the lying surface.

3. The lying surface according to claim 2, wherein the lying surface comprises a center region (30) and two outer regions (30', 30"), and the lamellae (23, 24) in the two outer regions (30', 30") are spaced further apart from another than the lamellae disposed in the center region (30) of the lying surface.

4. The lying surface according to claim 1, further comprising an upper and a lower cushioning body extending having mechanical density and wherein the mechanical density of the upper and lower cushioning bodies is different from each other.

5. The lying surface according to claim 1, wherein the upper and the lower cushioning body (8, 9) are covered by insulation fleece sheets (10, 11), which insulatingly seal the upper and lower cushioning body (8, 9)respectively.

6. The lying surface according to claim 5, wherein the upper insulation fleece sheets (10), the upper cushioning body (9), the upper and the lower lamellar grid (6, 7), the lower cushioning body (8) and the lower insulation fleece sheets (11) are disposed in a common covering (12).

7. The lying surface according to claim 6, wherein the upper cushioning body (9) and the insulation fleece sheets (10) are disposed in a first fabric flap (13, 18) and the upper and the lower lamellar grid (6, 7) is disposed in a second fabric flap (13, 18) and the lower cushioning body (8) with the lower insulation fleece sheet (11) is disposed in a third fabric flap (13, 18), wherein the fist, second and third fabric flap (13, 18) are interconnected.

8. The lying surface according to claim 1, wherein the lamellar grid (6, 7) is electro-mechanically adjustable.

9. The lying surface comprising an with upper cushioning body (9) and at least two upper and lower lamellar grids (6, 7), arranged parallel to each other and which are placed on elastic bodies (3, 4) extending longitudinally along the lying surface, wherein the lower lamellar grid (7) rests on a lower cushioning body (8), which cushioning body (8) is placed on two spaced-apart bearing members (27), which bearing members (27) are fastened to the longitudinal sides of a bed frame.

* * * * *